United States Patent [19]

Komatsubara et al.

[11] Patent Number: 4,777,509

[45] Date of Patent: Oct. 11, 1988

[54] SYSTEM FOR LOADING SHEET MATERIALS ON A ROTARY DRUM

[75] Inventors: Shoji Komatsubara; Yoshio Miyauchi; Yukio Hatabe, all of Hikone, Japan

[73] Assignees: Dainippon Screen Mfg., Co. Ltd.; Ishihara Sangyo Kaisha Ltd., both of Japan

[21] Appl. No.: 819,817

[22] Filed: Jan. 16, 1986

[30] Foreign Application Priority Data

Feb. 1, 1985 [JP] Japan ..... 60-19147

[51] Int. Cl.[4] ..... G03G 15/00

[52] U.S. Cl. ..... 355/3 R; 355/3 DR; 355/3 SH; 355/10; 355/16; 355/73; 271/194; 271/275; 101/178

[58] Field of Search ..... 355/3 R, 3 SH, 3 DR, 355/7, 10, 16, 73, 13; 271/275, 194, 307, 311; 101/178, 232, 407 A

[56] References Cited

U.S. PATENT DOCUMENTS

| | | | |
|---|---|---|---|
| 1,964,098 | 6/1934 | Wainwright et al. | 101/170 |
| 3,308,751 | 3/1967 | Hata | 101/178 |
| 3,674,362 | 7/1972 | Ando | 355/10 |
| 3,782,818 | 1/1974 | Smith | 355/10 |
| 3,893,760 | 7/1975 | Thettu | 355/3 TR |
| 3,906,501 | 9/1975 | Kiess | 355/3 R X |
| 4,056,314 | 11/1977 | Silverberg | 355/10 |
| 4,147,128 | 4/1979 | Muller | 355/3 DR X |

FOREIGN PATENT DOCUMENTS

| | | |
|---|---|---|
| 56-24270 | 6/1981 | Japan . |
| 59-171676 | 9/1984 | Japan . |

OTHER PUBLICATIONS

Schaffert, R. M, "Electrophotography", Focal Press Limited, London, England, 1975, pp. 372–373.

*Primary Examiner*—Arthur T. Grimley
*Assistant Examiner*—Jane K. Lau
*Attorney, Agent, or Firm*—Brumbaugh, Graves, Donohue & Raymond

[57] ABSTRACT

A system for loading sheet materials on a rotary drum, having carrier for carrying sheet materials to the drum, a mechanism for catching the leading end of the sheet materials on the drum, and a presser member for pressing the sheet materials to said drum rotating, so as to wind said sheet materials around said drum, wherein said system involves a dampening arrangement for dampening the space between sheet materials and the drum surface, which is mirror finished, so as to contact said sheet materials with said peripheral surface of said drum.

7 Claims, 1 Drawing Sheet

SYSTEM FOR LOADING SHEET MATERIALS ON A ROTARY DRUM

FIELD OF THE INVENTION

The present invention relates to a system for loading sheet materials on a rotary drum, especially to such system having means for holding the leading end of the sheet materials on the drum, and means for pressing the sheet materials to said drum rotating, so as to wind said sheet materials around said drum.

BACKGROUND OF THE INVENTION

Such systems for loading sheet materials on a rotary drum are disclosed by Japanese Patent Publication No. 56-24270, or Japanese Open Patent Publication No. 59-171676, for example.

In the former publication, the system involves a suction opening which suckes back surface of the sheet materials at the leading end. And in the latter publication, the system involves a clamp mechanism (gripper) for clamping the leading end of the sheet materials.

In such system, it is desirable that the sheet materials perfectly contact with the peripheral surface of the drum. But, according to these prior arts, it is found that there are partial spaces between the sheet materials and the peripheral surface of the drum sometimes.

Therefore, in case that these prior arts are applied to an electrophotocopying machine of CPC type, the image is out of focus at the risen part from the drum surface, making the sharpness lower, and liquid developer invades into the partial spaces between the sheet materials and the peripheral surface of the drum, blotting the back of the sheet materials.

And in case that these prior arts are applied to a rotary press for light printings, which uses a master paper as sheet forms, inks enter into the spaces between the master paper and the drum and decreases the value of goods when they are adhered to the margine part of the paper. Moreover, the master paper is partially spaced from the drum by the centrifugal force during high speed printing.

The suction opening is desirable for making no turning-in at the leading end of the sheet materials. But, it may allow of the slip or creases of sheet materials, which may be fatal defects for color copying obtained through several different color developments on one developing paper by a color electrophotocopying machine or the like, especially, when the spaces mentioned above is broken out.

When hard or thick sheet materials are used, the sheet materials is tending to rise from the drum surface by the reaction of cylindrical bending along the drum, in comparison with the different case in which the sheet materials are laid on a flat form. Therefore, there is limitation of the sheet materials in thickness or hardness thereof.

Therefore, the object of the present invention is to propose a system for loading sheet materials on a drum, which disadvantages abovementioned are resolved.

DISCLOSURE OF THE INVENTION

To achieve the object abovementioned, a system for loading sheet materials on a drum, described in the opening paragraph, according to the present invention, essentially involves a dampening arrangement for dampening of the sheet materials back surfaces and/or drum surface at least before holding of leading end of the sheet materials, and the drum having a mirror finished peripheral surface, so as to tightly contact the sheet materials on the peripheral surface of the drum.

At least one of the sheet materials or drum is dampened by the dampening arrangement before the leading end of the sheet materials is caught by means for catching, then the leading end of the sheet materials is caught and loaded by winding it around the drum. The space between sheet materials, which is pressed to the drum surface by the presser member, and drum surface is dampened and contacted tightly each other with no space therebetween. Thus, the partial space between them, slip and creasing of the sheet materials, both are brought out by the partial space therebetween are prevented.

BEST MODE FOR PRACTICING THE INVENTION

A color electrophotocopying machine according to the present invention is explained hereinafter.

Figure 2:
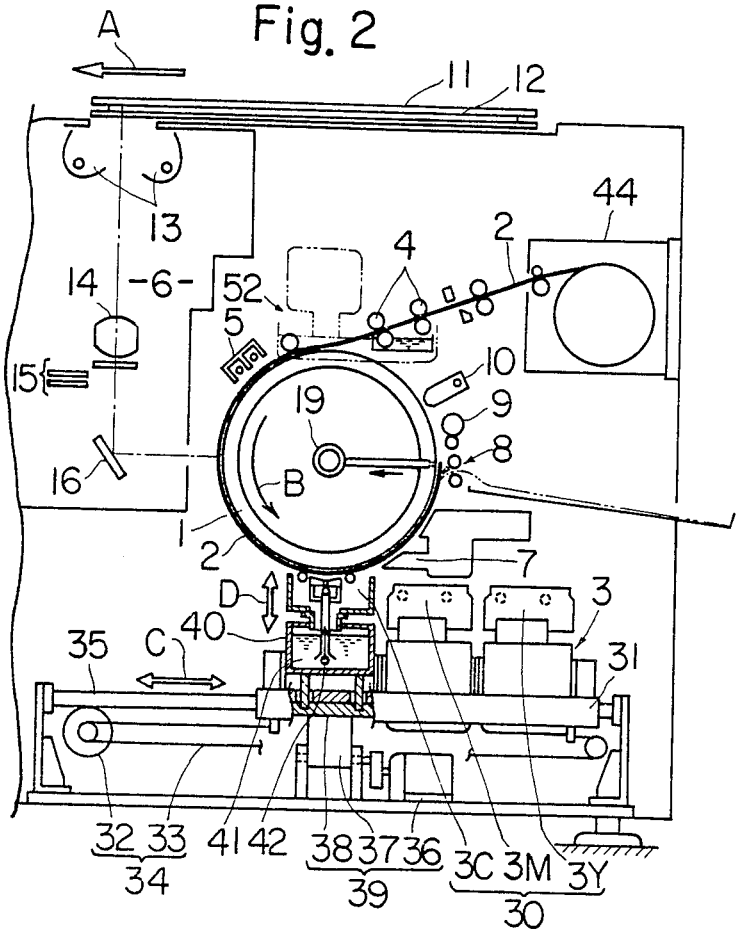
FIG. 2 is a schematic side view of the color electrophotocopying machine according to the present invention.

FIG. 2 is a schematic side view of the color electrophotocopying machine according to the present invention. In FIG. 2, drum 1 is provided for loading a sheet of light sensitive paper 2, and a developing machine 3 which developes electrostatic latent image formed on the light sensitive paper 2, and which is arranged to feed different color developers orderly as described later. The machine is provided with a feeder 4 which feeds light sensitive paper 2 to the drum 1, a charging device 5 which charges static electricity to the light sensitive paper 2, an optical instrument 6 for producing an electrostatic latent image, a developing machine 3, an air knife 7, a remover 8 for removing sheet materials from the drum 1, drum cleaner 9, a discharger 10, and so on. They are disposed against the drum 1 and in order.

The optical instrument 6 is provided with a holding frame 11 for holding an original 12, a light source 13, one or a set of lenz 14, color filters 15, and a mirror 16, so as to form an electrostatic latent image by projecting optical slit images of the original, which optical slit images are obtained by moving the holding frame 11 holding the original 12, in the direction designated by an arrow A.

The developing part 30 of the wet developing machine 3 has a cyanic developing unit 3C, a magenta developing unit 3M, yellow developing unit 3Y, and optical gray developing unit (not shown), for developing separated color electrostatic latent images. One separated color electrostatic latent image is formed and developed on a developing paper 12 monochromatically. Then, the formings of different separated color electrostatic latent images and developements of them on the same paper 2 are carried in the same way orderly by color.

These developing units 3C, 3M, 3Y are movable up and down (in the direction of the arrow D) and carried by the carrier 31 which moves right and left (in the direction of the arrow C). The carrier 31 is moved and positioned by a driving device 34 having a motor 32, a chain 33 and so on, and any one of developing unit, which is desired to work, approaches to the surface of developing paper 2 by means for lifting the developing unit 39, which involves a motor 36, a lifting crank mechanism 37, a lifting table 38 and so on, in order to feed developer 41 from a developer tank 40 to the surface of light sensitive paper 2 by a feeding pump 42.

Figure 1:
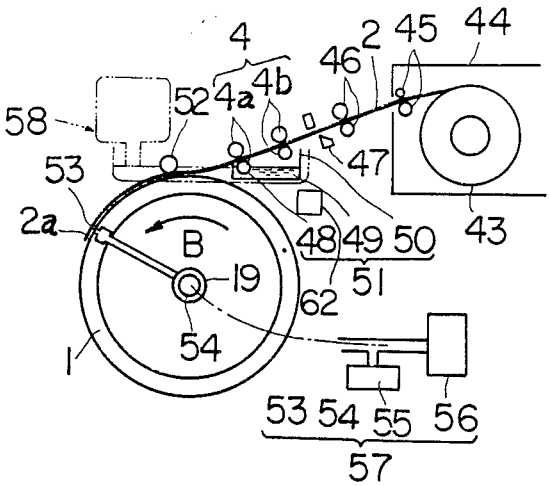
FIG. 1 is a side view of the essential part of the invention.

FIG. 1 is a side view of the essential part of the present invention, wherein a casset reel 43 for rolled light sensitive paper 2 is housed in a magazine 44 having a pair of rollers 45 for taking out the leading end of the light sensitive paper 2 from the magazine 44 in order to insert it to a pair of feeding roller 46. A paper carrier 4 involves two pairs of rollers 4*a*, 4*b* which carry the light sensitive paper 2 fed from the feeding rollers 46. The speed of the paper 2 carried by this paper carrier 4 is controlled by an usual timing controller (not shown) which delivers pulses for controlling the work timing the connected electric parts or circuits by numbers of pulses, so as to be synchronized with the rotating position of the suction port 53 of the drum 1 rotating in the direction of an arrow B. A cutter 47 is disposed between feeding rollers 46 and the paper carrier 4. The developing paper 2 is pressed to the drum 1 by the presser member 52.

These constitutions of the inventions described hereinbefore are known constitutions, and the essential and particular constitutions, which feature the present invention, of the present invention will be described hereinafter.

A dampening arrangement 51 is positioned under the carrier rollers 4*a*, 4*b* for dampening the light sensitive paper 2. This dampening arrangement 51 involves a dampening roller 48 consisted of the lower one of a pair of carrier roller 4*a*, so as to feed dampening agents 49 (for example, solvent of the developer 41) from a tray 50 to the back surface of the light sensitive paper 2. A drum dampening arrangement 62 also exists for the surface of the rotary drum 1.

Of course, the constitution of the dampening arrangement 51 is not limited in that described above. For example, the independent dampening roller (of porus elastomer such as sponges), or showering system, spraying system, brush and so on may be altered with the carrier roller 4*a*(48).

The dampening arrangement may be adapted to dampen both the surface of the drum 1 and the light sensitive paper 2, or only the surface of the drum 1. Any way, it is necessary that the space between the drum 1 and the paper 2 is soaked with the dampening agents. The preferable composition of the dampening agents may be selected taking acount of the type of machine to be applied.

As dampening agent may be used in case of electrophotographic printing in conjunction with the present invention, there may be used various organic liquid, preferably, solvent of liquid developer for electrophotography such as electrically insulating carrier liquid of the liquid developer. If there was no particular limitation, water may be used as the dampening agent.

The dampening agents 49 is supplied by the supply system 58 shown by imaginary lines, and placed at one side of the drum 1.

The surface of the drum 1 is mirror finished and the roughness which is obtained by electroplating may suffice required roughness generally. But, the character of the dampening agents influences the requirement in the roughness, so that it may be considerably rough in some case, or considerably fine or smooth in other case.

A suction opening 57 for catching the leading end 2*a* of the light sensitive paper 2 is assembled in the drum 1, and involves a suction port 53 formed on the drum surface parallel with the axis of the drum 1. The suction port 53 is communicated with a vacuum pump 56 located outside of the drum 1, via duct 54 formed in the drum axle 19, and a pressure sensor 55 disposed outside of the drum 1.

The suction port 53 may involve a numerous numbers of suction bores aligned in the direction of the drum axis, or one or more openings like slits.

The pressure sensor 55 is provided for detecting the miss in catching of the light sensitive paper 2 by sensing the drop of vacuum pressure under the predetermined value, and for breaking out of emergency alarm, and/or work of the copying machine, so as to prevent jam of the light sensitive paper when the miss is found out thereby.

The invention is explained along its application to a color electrophotocopying machine herein above, but the field, to which the present invention can be applied, is not limited within there, but in the field of monochromatic electrophotocopying machine, rotary press for a light printings, and so on.

In case of the rotary press according to the invention, it is possible to prevent the invasion of the oil inks into the space between the master paper, which is the form, and presser drum by repelling it with water used as the dampening agents 49.

Of course, the means for holding the leading end of the developing paper, being comprised of a suction opening may be altered with a clamping mechanism, or known gipper, for example.

As said photosensitive sheet may be used in conjunction with the present invention comprise a backing of relatively electrically conductive material sheet such as paper or plastic film, coated with an electroconductive materials or of metal plate having a coating of electrophotoconductive material layer such as titanium dioxide, zinc oxide and the like dispersed in a resinous binder on one surface thereof to provide the photoconductive surface, especially, in case that titanium dioxide containing photosensitive sheet is employed in the present invention, thereby resulting multi-color print image having high contrast with good continuous gradation of the image such as that pictorial tone resembling the appearance obtainable in silver halide photography.

EFFECTS OF THE INVENTION

According to the present invention, the sheet materials is loaded with dampening of the space between sheet materials and drum surface, so that the following outstanding advantages are brought out.

A. The back of the sheet materials is tightly contacted with the drum surface, so that the slip and creasing of the sheet materials caused by the rising of sheet materials from the drum surface is prevented.

B. And the focus of the copying or reproduction is kept correct, in case of electrophotocopying machine according to the present invention.

C. The color discrepancy caused by the slip or creasing of the sheet materials is eliminated in case of color electrophotocopying machine according to the present invention.

D. The disadvantage of the usual rotary press for light printing, that the value of goods is spoiled by the inks invaded in the space between the master paper and the drum, is eliminated in case of rotary press according to the present invention.

E. The thicker or harder sheet materials are able to load on a drum without rising thereof from the drum surface, so that the sorts of the sheet materials to be loaded on a drum is increased.

We claim:

1. A device for automatically loading sheet materials having photoconductive layers thereon onto a rotary drum in an electro-photographic copying apparatus having sheet material feed means for automatically feeding sheet materials onto a peripheral surface of the rotary drum, charger means disposed adjacent to the peripheral surface of the rotary drum for applying static electricity, exposure means including predetermined optical filters for producing a latent image of an original to be copied, and a developer station for supplying a plurality of developers to the sheet materials synchronously with the rotation of the rotary drum, to make the latent image visible, said device for automatically loading sheet materials comprising:

suction means provided at a predetermined position of the peripheral surface of the rotary drum so as to hold the leading edge of said sheet material; and dampening means for supplying a solvent of the plurality of developers to at least one of the peripheral surface of said rotary drum and back surface of said sheet material, before the leading edge of the sheet material is held;

a mirror finished surface formed on said peripheral surface of the rotary drum, so that said sheet material is received thereon in cooperation with the solvent supplied thereto.

2. A device according to claim 1, wherein said suction means includes a suction opening.

3. A device according to claim 2, wherein said suction means further includes a pressure sensor.

4. A device according to claim 1, wherein said solvent is an electrically insulating carrier liquid of the plurality of developers.

5. A device according to claim 1, wherein said sheet materials are photosensitive sheets adapted for electrophotography.

6. A device according to claim 5, wherein said photosensitive sheet has a photoconductive layer formed by titanium dioxide.

7. A device according to claim 1, wherein electrophotographic copies are superposed sequentially to form multi-color toner image.

* * * * *

UNITED STATES PATENT AND TRADEMARK OFFICE

CERTIFICATE OF CORRECTION

PATENT NO. : 4,777,509

DATED : October 11, 1988

INVENTOR(S) : Komatsubara et al.

It is certified that error appears in the above-identified patent and that said Letters Patent is hereby corrected as shown below:

First page, Item [56], Second Column, between lines 1 and 2 insert --4,134,147 1/1979 Watanabe--; after line 5 insert --1,208,723 Great Britain; 578,560 Japan (Abstract)--; line 9 insert --XEROX DISCLOSURE JOURNAL, VOL. 1, NO. 3, MARCH 1976, PAGE 35, XEROX CORPORATION, STAMFORD, US: C. WHITED: "PAPER PRE-COATING SYSTEM"--.

Signed and Sealed this

Thirteenth Day of June, 1989

*Attest:*

*Attesting Officer*

DONALD J. QUIGG

*Commissioner of Patents and Trademarks*